US007449941B2

(12) United States Patent
Zadeh et al.

(10) Patent No.: US 7,449,941 B2
(45) Date of Patent: Nov. 11, 2008

(54) MASTER BIAS CURRENT GENERATING CIRCUIT WITH DECREASED SENSITIVITY TO SILICON PROCESS VARIATION

(75) Inventors: Ali E. Zadeh, Sierra Madre, CA (US); Ashirwad Bahukhandi, Pasadena, CA (US)

(73) Assignee: Micron Technology, Inc., Boise, ID (US)

( * ) Notice: Subject to any disclaimer, the term of this patent is extended or adjusted under 35 U.S.C. 154(b) by 118 days.

(21) Appl. No.: 11/467,314

(22) Filed: Aug. 25, 2006

(65) Prior Publication Data

US 2008/0048770 A1 Feb. 28, 2008

(51) Int. Cl.
*G05F 3/02* (2006.01)

(52) U.S. Cl. ..... 327/543; 327/542; 323/315

(58) Field of Classification Search ..... 323/313–317; 327/512, 513, 538–543

See application file for complete search history.

(56) References Cited

U.S. PATENT DOCUMENTS

| | | | | |
|---|---|---|---|---|
| 5,362,988 | A * | 11/1994 | Hellums | 327/543 |
| 5,559,425 | A * | 9/1996 | Allman | 323/315 |
| 5,627,456 | A * | 5/1997 | Novof et al. | 323/315 |
| 6,377,114 | B1 * | 4/2002 | Sakurai | 327/543 |
| RE38,250 | E * | 9/2003 | Slemmer | 327/539 |
| 7,227,401 | B2 * | 6/2007 | Zhang et al. | 327/513 |

* cited by examiner

*Primary Examiner*—Lincoln Donovan
*Assistant Examiner*—William Hernandez
(74) *Attorney, Agent, or Firm*—Dorsey & Whitney LLP

(57) ABSTRACT

A master bias current generating circuit includes a current source, a first reference leg, and a second reference leg. The first reference leg includes a first transistor having a first size parameter coupled to the current source and a first diode having a second size parameter coupled to the first transistor. The second reference leg includes a second transistor having a third size parameter less than the first size parameter coupled to the current source and a second diode having a fourth size parameter greater than the second size parameter coupled to the second transistor.

18 Claims, 4 Drawing Sheets

MASTER BIAS CURRENT GENERATING CIRCUIT WITH DECREASED SENSITIVITY TO SILICON PROCESS VARIATION

CROSS-REFERENCE TO RELATED APPLICATIONS

Not applicable.

STATEMENT REGARDING FEDERALLY SPONSORED RESEARCH OR DEVELOPMENT

Not applicable

BACKGROUND OF THE INVENTION

The present invention relates generally to digital and mixed-signal circuit devices and, more particularly, to a master bias current generating circuit with decreased sensitivity to silicon process variation.

In typical CMOS analog and mixed-signal analog-digital chips, such as imaging products, power management products, and biomedical products, there is a need for a circuit to generate a master bias current. This master bias current generator produces a reference current used in feeding the currents to all or most of the analog blocks, such as operational amplifiers, digital-to-analog converters, and analog-to-digital converters, oscillators, buffers, etc.

As a stand-alone block, the master bias current generator plays an important role in any mixed-signal chip. The functionality, speed, and accuracy of all other analog blocks, such as operational amplifiers, depend on the current produced by the master bias current generator. Before any block is turned on for processing signals, the master bias current generator must be available to produce the current needed. Over the operating temperature variation range of the device (e.g., commercial: −30° C. to 70° C., industrial: −40° C. to 85° C., or military: −55° C. to 125° C.), the master bias current generator must produce a current which is proportional to temperature. The produced master bias current should preferably have a substantially small variation due to variation in the power supply, commonly referred to as power supply rejection ratio. Also, it is desirable to have a master bias current generator that produces a current that is substantially insensitive to silicon process variation.

FIG. 1 illustrates a prior art master bias current generator circuit 100. As seen in FIG. 1, the master bias current generator circuit 100 includes a current generating portion 105 that generates the master bias current, and a current replicating portion 110 that replicates and scales the master bias current so that it may be provided to an analog block of the associated device. Although only one replicating portion 110 is show, a typical device will include many replicating portions to distribute the master bias current to its consumers. The generating portion 105 includes a PMOS current source 115 including transistor 120 and diode-connected transistor 125 and an NMOS current source 130 including a diode-connected transistor 135 and a transistor 140. The complementary PMOS and NMOS current sources 115, 130 cause an equal current to flow into two diode-connected substrate PNP transistors 145, 150.

Typically, the PNP transistors 145, 150 have areas that are multiples of one another. For example, the transistor 150 is commonly eight times larger than the transistor 145. A resistor 155 having a resistance of R is provided between the transistor 140 and the PNP transistor 150. The resistor 155 is realized on chip using a polysilicon layer or an N-well resistor. Variations of prior art master bias circuits include cascoded PMOS and/or NMOS current sources, wide swing biased current sources, or an operational amplifier in place of the NMOS current source 130.

In all these prior art circuits, the generating portion 105 of the master bias current generator circuit 100 provides a reference current, $I_{REF}$, that flows into the diode-connected PNP transistors 145, 150. Often, the master bias current generator circuit 100 is designed to have the same reference current flowing into both diode-connected PNP transistors 145, 150. However, in some cases, the master bias current generator circuit 100 may configured such that the current passing through one transistor 145 is a multiple of the current passing through the other 150. This scaling may be accomplished by varying the aspect ratios of the PMOS transistors 120, 125 in the PMOS current source 115, as is known to those of ordinary skill in the art.

The replicating portion 110 produces a current which is directly proportional to $I_{REF}$. The replicating portion 110 includes PMOS transistors 155, 160 having their gate terminals coupled to the gate terminals of the corresponding PMOS transistors 120, 125 in the current generating portion 105 and diode connected NMOS transistors 170, 175. Typically, the output current generated by the replicating portion 110 is an integer scaling of $I_{REF}$. Generally, the scaling is proportional to the ratio of the aspect ratio (W/L) of the transistors 160, 165 to that of the transistors 120, 125 in the generating portion 105.

In the basic architecture in FIG. 1, assuming that the $I_{REF}$ currents in both sides of the current source are identical, and the emitter area of the PNP transistor 150 is M times the emitter area, A, of the PNP transistor 145, then $I_{REF}$ current can be written as:

$$I_{REF} = \frac{V_T}{R}\mathrm{Ln}\left(\frac{M \times A}{A}\right) = \frac{V_T}{R}\mathrm{Ln}(M) \tag{1}$$

where $V_T$ represents the characteristic thermal voltage (e.g., approximately 26 mV at room temperature).

In typical semiconductor processes, the performance of parameter in a circuit that is ratio of two elements such as ratio of capacitor values, ratio of resistor values, or ratio of areas, etc. is relatively insensitive to process variation. Hence, the variation of $I_{REF}$ due to variations in the emitter areas of the PNP transistors 145, 150 (i.e., A and M×A) is insignificant. It is for just this reason that, the emitter area of the transistor 150 is an integer multiple of the emitter area of the transistor 145.

However, one significant limitation of the prior art master bias current generator 100 arises from the fact that the reference current is a direct function of the absolute resistance, R, of the on-chip resistor 155. As this resistor 155 is realized using a polysilicon layer, source-drain diffusion layer, or N-well resistor, any variation in the absolute resistance is directly inversely related to the reference current produced. In a typical CMOS process, variation in the absolute value of a resistor made of polysilicon can be approximately ±15-20%. In some semiconductor processes, this variation may even be as much as ±30-35%, depending upon the layer used to realize the resistor. This relatively large level of variation may be unacceptable for a particular implementation.

Various techniques for reducing the variation arising from the resistor. In one technique, an external resistor may be used. However, such an external resistor is costly due to the need for an external component and two additional external pads on the device. Another technique is to use a trimming method that allows circuits to be altered to affect the overall resistance. The resistance may be adjusted using a fuse or laser trimming to reduce variation of the current. However, the trimming technique is also costly due to the increased circuit complexity and labor associated with the trimming process.

This section of this document is intended to introduce various aspects of art that may be related to various aspects of the present invention described and/or claimed below. This section provides background information to facilitate a better understanding of the various aspects of the present invention. It should be understood that the statements in this section of this document are to be read in this light, and not as admissions of prior art. The present invention is directed to overcoming, or at least reducing the effects of, one or more of the problems set forth above.

BRIEF DESCRIPTION OF THE SEVERAL VIEWS OF THE DRAWINGS

The invention will hereafter be described with reference to the accompanying drawings, wherein like reference numerals denote like elements, and.

Figure 1:
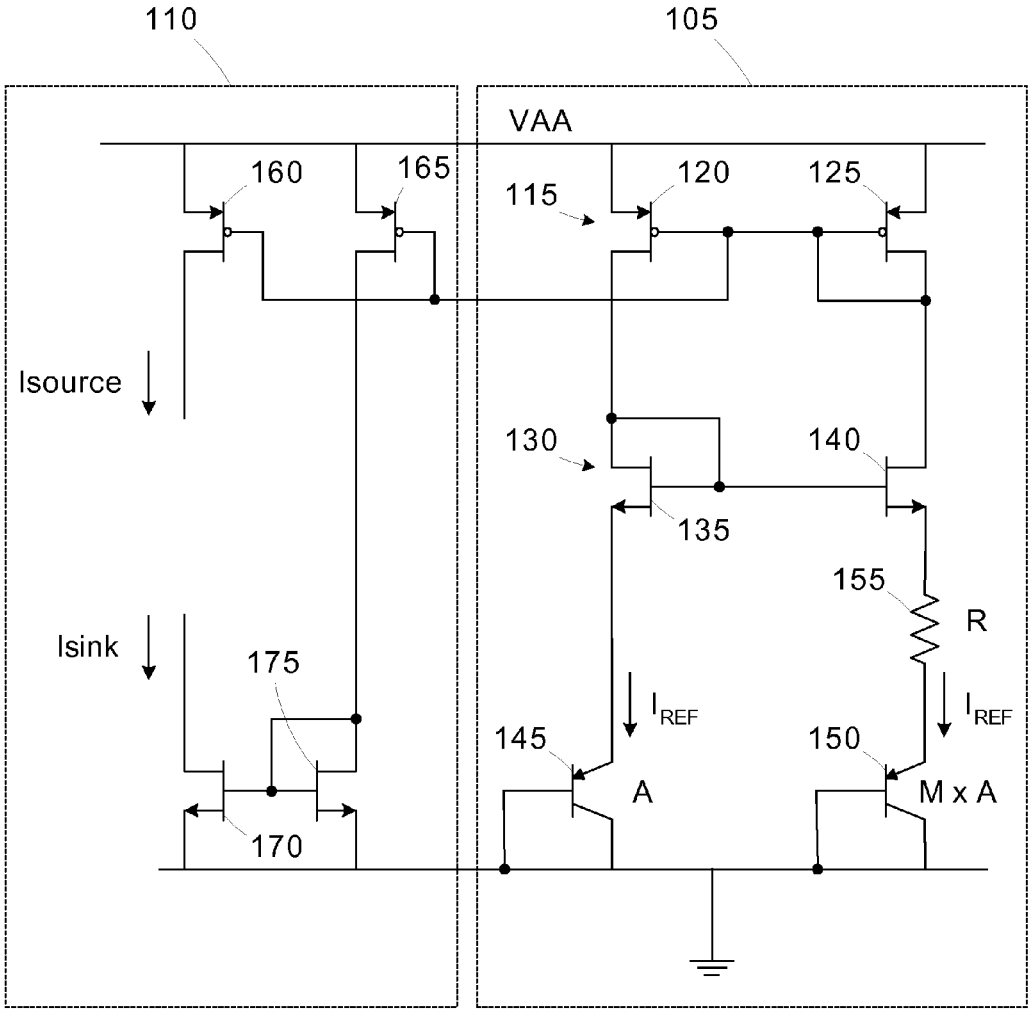
Figure 1 (Prior Art)
FIG. 1 is a circuit diagram of a prior art master bias current generator.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

One or more specific embodiments of the present invention will be described below. It is specifically intended that the present invention not be limited to the embodiments and illustrations contained herein, but include modified forms of those embodiments including portions of the embodiments and combinations of elements of different embodiments as come within the scope of the following claims. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical or essential to the present invention unless explicitly indicated as being "critical" or "essential."

The present invention will now be described with reference to the attached figures. Various structures, systems and devices are schematically depicted in the drawings for purposes of explanation only and so as to not obscure the present invention with details that are well known to those skilled in the art. Nevertheless, the attached drawings are included to describe and explain illustrative examples of the present invention. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 2:
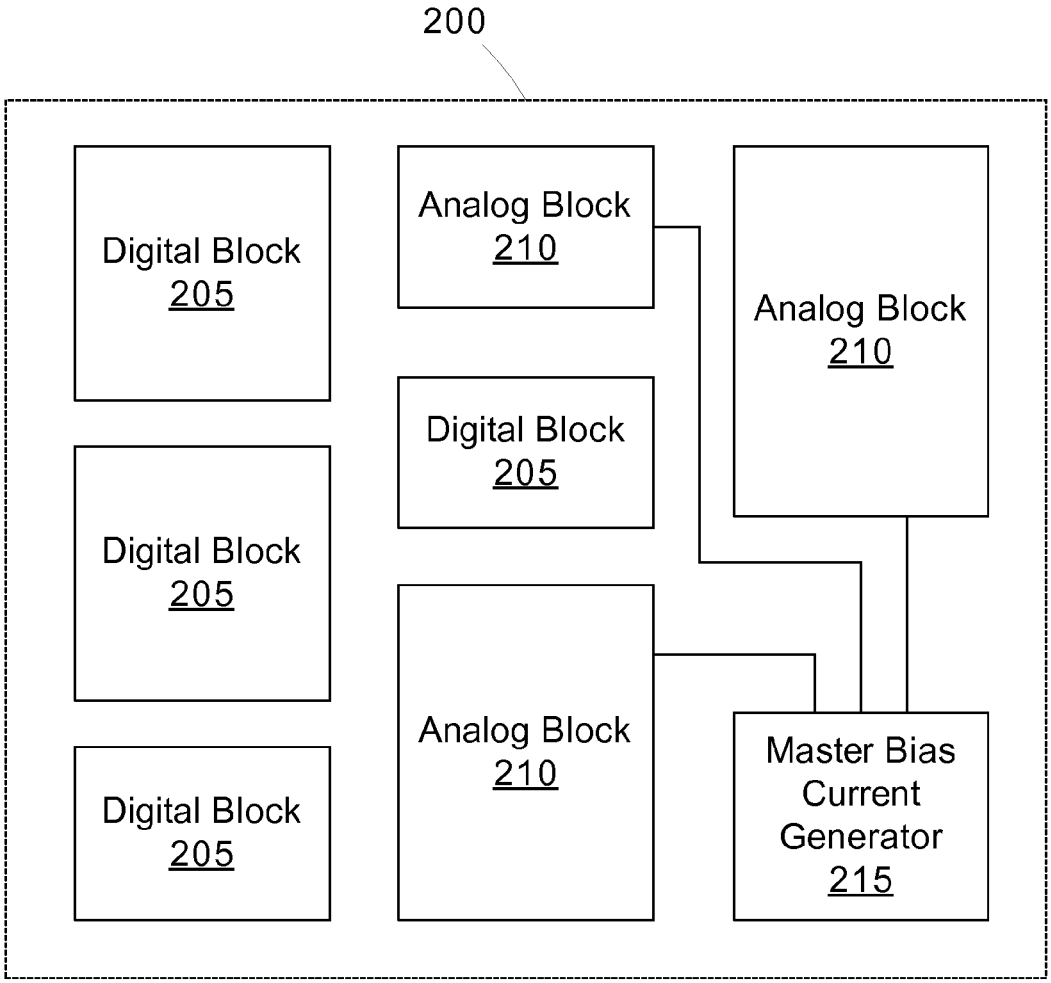
FIG. 2 is a simplified block diagram of a mixed-signal integrated circuit device in accordance with one illustrative embodiment of the present invention.

Referring now to the drawings wherein like reference numbers correspond to similar components throughout the several views and, specifically, referring to FIG. 2, the present invention shall be described in the context of an integrated circuit device 200. In the illustrated embodiment, the integrated circuit device 200 is a mixed-signal device including digital blocks 205 and analog blocks 210 formed on a common substrate. A master bias current generator 215 is provided for generating a master bias current signal for use by the analog blocks 210. Exemplary analog components that may use the master bias current include operational amplifiers, digital-to-analog converters, and analog-to-digital converters, oscillators, buffers, etc. The particular size and layout of the digital blocks 205 and analog blocks 210 are provided for illustrative purposes only. An actual implementation may include different circuit arrangements. Exemplary mixed-signal analog-digital devices include imaging devices, power management devices, biomedical devices, and many others.

Figure 3:
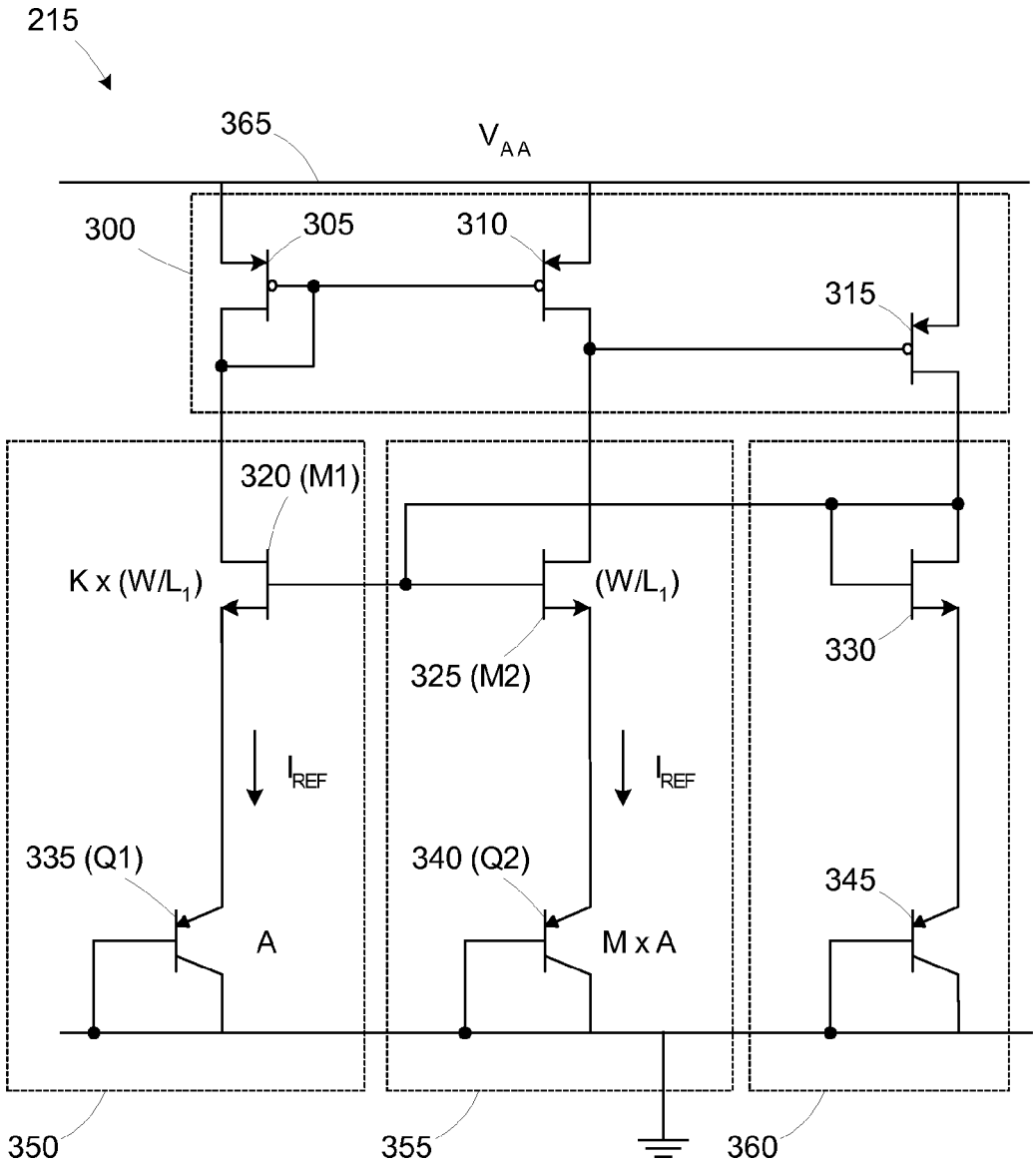
FIG. 3 is a circuit diagram of a master bias current generator that may be used in the device of FIG. 2.

Turning now to FIG. 3, a circuit diagram of the master bias current generator 215 is provided. For clarity and ease of illustration, only the current generation portion of the circuit is illustrated. Any number of replicating/scaling legs (i.e., as illustrated in the prior art circuit of FIG. 1) may be used, but these are omitted to avoid obscuring the present invention. The master bias current generator 215 includes a current source 300 incorporating PMOS field effect transistors 305, 310, 315. NMOS field effect transistors 320, 325, 330 and PNP bipolar transistors 335, 340, 345 are also provided. The transistors 320, 335 define a first reference leg 350, the transistors 325, 340 define a second reference leg 355, and the transistors 330, 345 define a bias leg 360. An input voltage, $V_{AA}$, is provided at an input voltage terminal 365. The application of the present invention is not limited to the particular circuit element types shown. For example, the dopant-type of transistors may be changed or diodes may be used in place of the diode-connected transistors. The master bias current generator circuit 215 may be implemented using an NMOS current source, PMOS reference leg transistors, or NPN bipolar transistors.

The PMOS transistor 305 is diode-connected and the gates of the PMOS transistors 305, 310 are coupled to one another to form the current source 300. The gate-source voltage, $V_{GS}$, of the PMOS transistor 305 equals its drain-source voltage, $V_{DS}$, and the $V_{GS}$ of the PMOS transistors 305, 310 are equal. The gate of the PMOS transistor 315 is coupled to the drain of the PMOS transistor 310, so that the PMOS transistor 315 may operate as a feedback device that forces the $V_{DS}$ of the PMOS transistors 305, 310 to be equal to eliminate current imbalance and cancel the effects of the Early voltage, $V_A$.

The NMOS transistors 320, 325 form a voltage loop with the PNP transistors 335, 340 to generate the reference current, $I_{REF}$. In the illustrated embodiment the reference currents are equal in both legs of the master bias current generator 215 due to the transistors 305, 310 in the current source 300 having the same aspect ratios (W/L). The current in the reference legs 350, 355 may be scaled with respect to one another by varying the aspect ratios of the transistors 305, 310. The NMOS transistor 330 biases the gate voltage of the transistors with a voltage equal to the emitter-base voltage, $V_{EB}$, of the PNP transistor 345 plus the $V_{GS}$ of the NMOS transistor 330.

The emitter area of the transistor 340 is a multiple (M×A) of the emitter area (A) of the transistor 335. The aspect ratios of the NMOS transistors 320, 325 are also multiples of one another. For example, if the aspect ratio of the transistor 325 is represented as $W/L_1$, the aspect ratio of the transistor 320 is $K\times(W/L_1)$. The transistors 330, 345 in the bias leg 360 are sized to match the corresponding pair in one of the reference legs 350, 355 (e.g., $W/L_1$ and M×A or $K\times(W/L_1)$ and A).

Generally, the master bias current generator 215 generates different emitter-base voltages, $V_{EB}$, for the PNP transistors 335, 340 due to the different emitter areas and causes that voltage difference to drop across the $V_{GS}$ of the NMOS transistors 320, 325 having different aspect ratios. In the following equations, the NMOS transistors 320, 325 are referred to as M1 and M2, respectively, and the PNP transistors 335, 340 are referred to as Q1 and Q2, respectively. To examine how the reference current, $I_{REF}$, is set by the master bias current generator 215, consider the voltage loop equation arising from Kirchoff's Voltage Law (KVL) as follows:

$$V_{GS}(M2)+V_{EB}(Q2)=V_{GS}(M1)+V_{EB}(Q1) \tag{2}$$

In Equation (2), the emitter-base voltage of the PNP transistors 35, 340 and gate-source voltage of the NMOS transistors 320, 325 may be defined as follows:

$$V_{EB} = V_T \mathrm{Ln}\left(\frac{I_E}{J_S \times M \times A}\right) \tag{3}$$

where $V_{EB}$=Emitter-Base voltage of PNP Bipolar Transistor (Volt)

$V_T$=Thermal Voltage=kT/q=0.0259 V at room Temperature (Volt)

$I_E$=Emitter current flowing into PNP emitter (A)

$J_S$=Emitter Current Density ($A/m^2$)

M=Number of unit emitters in PNP

A=Area of one unit emitter in PNP ($m^2$)

$$V_{GS} = V_{TH} + \sqrt{\frac{2\times I_D}{\mu_N C_{OX}\frac{W}{L}}} \tag{4}$$

where $V_{GS}$=Gate-source voltage of NMOS Transistor (Volt)

$V_{TH}$=Threshold voltage of the NMOS transistor (Volt)

$I_D$=Drain (or Source) current of NMOS (A)

$\mu_N$=Electron mobility in the channel of an NMOS transistor $C_{OX}$=Gate oxide per unit area ($F/m^2$)

W/L=Width/Length which is the aspect ratio of an MOS transistor

Expanding the KVL voltage loop equation (2) results in:

$$V_{TH} + \sqrt{\frac{2\times I_{REF}}{\mu_N C_{OX}\frac{W}{L}}} + V_T \mathrm{Ln}\left(\frac{I_{REF}}{J_S \times M \times A}\right) = V_{TH} + \sqrt{\frac{2\times I_{REF}}{\mu_N C_{OX} K\frac{W}{L}}} + V_T \mathrm{Ln}\left(\frac{I_{REF}}{J_S \times A}\right) \tag{5}$$

where $V_{TH}$ is the threshold voltage of the NMOS transistors 320, 325 (M1 and M2), and $V_T$ is the thermal voltage.

To find a closed form solution, Equation (5) may be solved for reference current, $I_{REF}$:

$$I_{REF} = \frac{1}{2}\mu_N C_{OX}\left(\frac{W}{L}\right)\times\left[\frac{V_T \mathrm{Ln}(M)}{1-\frac{1}{\sqrt{K}}}\right]^2 \tag{6}$$

where $\mu_N$ is the electron mobility, $C_{OX}$ is oxide capacitance per unit area; and W/L is the width/length ratio of the NMOS transistors 320, 325.

The factors M and K are integer multiples of the NMOS aspect ratio and the PNP emitter area, respectively. In the illustrated embodiment, M is 8 and K is 2; however both may vary depending on the particular implantation. For instance, M may be between 4 and 100. Generally, a larger value for M increases the accuracy of $I_{REF}$ at the expense of increased chip real estate area. The values of M and K determine the amount of reference current. A larger current provides enhanced matching, but requires higher power consumption.

Both the M and K ratios may be defined precisely and their variations are typically very small in any semiconductor process. Also, in typical CMOS analog processes, the tolerance variation on oxide thickness $C_{OX}$, mobility $\mu_N$, channel width W, and channel length L are usually well-controlled. Hence, the variability of the parameters in Equation (6) that define the value of the reference current is significantly less than the variability in the resistance parameter that defines the reference current in Equation (1) for the prior art circuit 100 of FIG. 1.

Figure 4:
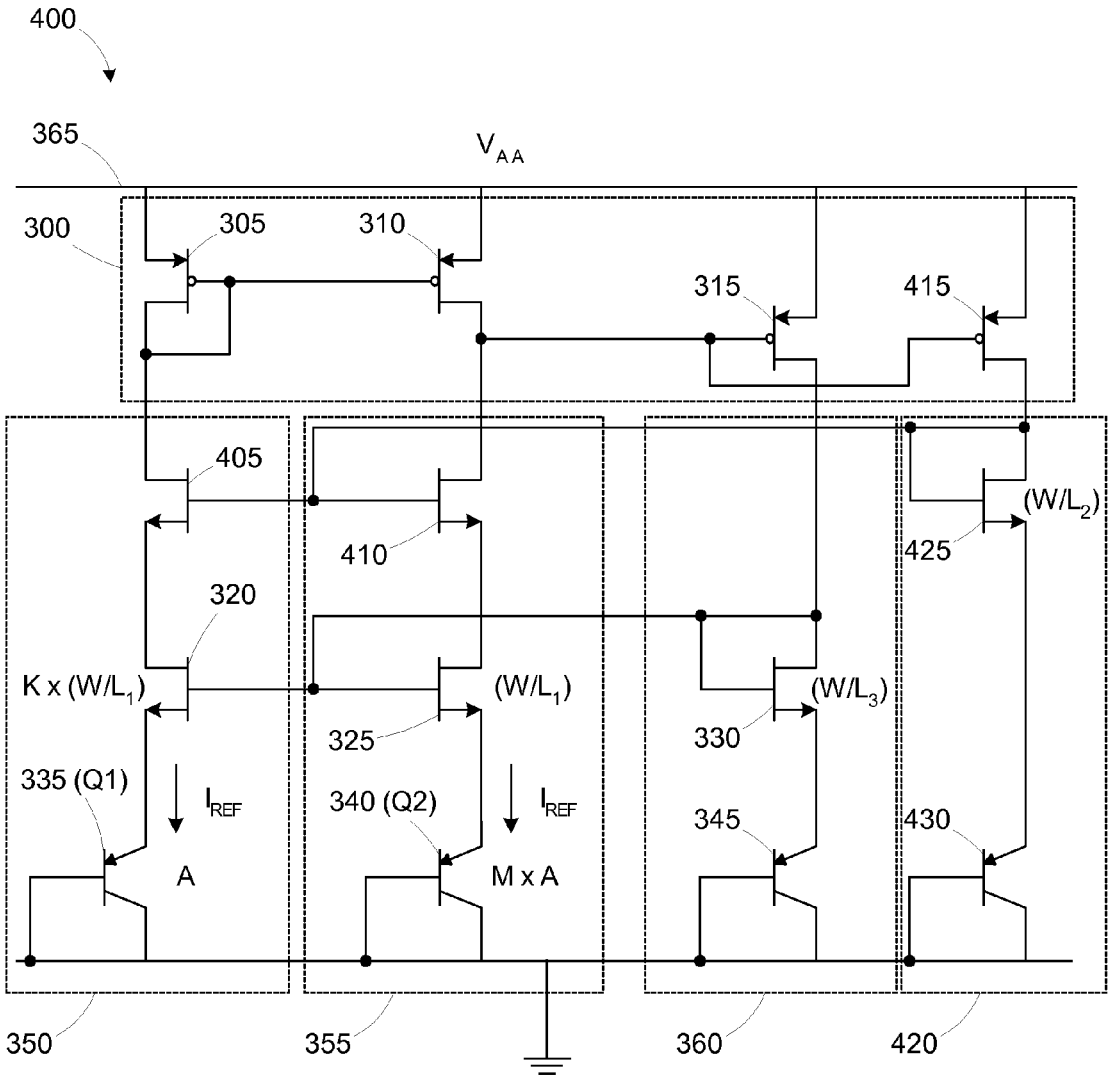
FIG. 4 is a circuit diagram of an alternative embodiment of a master bias current generator that may be used in the device of FIG. 2.

Turning now to FIG. 4, an alternative embodiment of a master bias current generator 400 is provided. In the master bias current generator 400, additional NMOS transistors 405, 410 are provided in the reference legs 350, 355 for cascading purposes. An additional PMOS transistor 415 is provided in the current source 300 for providing current to a second bias leg 420 is defined by an NMOS bias transistor 425 and an additional PNP transistor 430. Note that the aspect ratio of the bias transistor 425, $W/L_2$, is less than the aspect ratio $W/L_3$ of the bias transistor 330 to provide a higher DC voltage for biasing the transistors 405, 410. The cascoded NMOS transistors 320, 325 405, 410 increase the effective resistance of the reference legs 350, 355, thereby improving power supply rejection performance. Hence, variations in the power supply voltage, $V_{AA}$, will cause less variation in the reference current.

The master bias current generator circuits 215, 400 described herein exhibit increased performance and reduced variability relative to the prior art circuit 100 of FIG. 1 that employs a resistor in its reference leg. Because the master bias current generator circuits 215, 400 do not rely on a resistor in generating the reference current, the variability in the reference current due to silicon process variation is reduced.

One aspect of the present invention is seen in a master bias current generating circuit including a current source, a first reference leg, and a second reference leg. The first reference leg includes a first transistor having a first size parameter coupled to the current source and a first diode having a second size parameter coupled to the first transistor. The second reference leg includes a second transistor having a third size parameter less than the first size parameter coupled to the current source and a second diode having a fourth size parameter greater than the second size parameter coupled to the second transistor.

Another aspect of the present invention is seen where the first reference leg includes a first field effect transistor having a first aspect ratio coupled to the current source and a first diode-connected bipolar transistor having a first emitter area coupled to the first field effect transistor. The second reference leg includes a second field effect transistor having a second aspect ratio less than the first aspect ratio coupled to the current source and a second diode-connected bipolar transistor having a second emitter area greater than the first emitter area coupled to the second field effect transistor.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

We claim:

1. A master bias current generating circuit, comprising:

a current source;

a first reference leg including a first transistor having a first size parameter coupled to the current source and a first diode having a second size parameter coupled to the first transistor;

a second reference leg including a second transistor having a third size parameter less than the first size parameter coupled to the current source and a second diode having a fourth size parameter greater than the second size parameter coupled to the second transistor; and a bias leg coupled to the current source and including a third diode coupled to the current source and a fourth diode coupled to the third diode, wherein the third diode is coupled to bias gate terminals of the first and second transistors.

2. The circuit of claim 1, wherein the first and third size parameters comprise aspect ratio parameters.

3. The circuit of claim 1, wherein the first and second diodes comprise diode-connected bipolar transistors, and the second and fourth size parameters comprise emitter area parameters.

4. The circuit of claim 1, wherein the first size parameter is a first integer multiple of the third size parameter, and the fourth size parameter is a second integer multiple of the second size parameter.

5. The circuit of claim 1, wherein gate terminals of the first and second transistors are coupled to a bias voltage terminal.

6. A master bias current generating circuit, comprising:

a current source;

a first reference leg including a first field effect transistor having a first aspect ratio coupled to the current source and a first diode-connected bipolar transistor having a first emitter area coupled to the first field effect transistor; and a second reference leg including a second field effect transistor having a second aspect ratio less than the first aspect ratio coupled to the current source and a second diode-connected bipolar transistor having a second emitter area greater than the first emitter area coupled to the second field effect transistor; and wherein the current source comprises:

a third diode-coupled field effect transistor coupled to the first field effect transistor; and a fourth field effect transistor coupled to the second field effect transistor, wherein gate terminals of the third diode-coupled field effect transistor and the fourth field effect transistor are coupled to one another.

7. The circuit of claim 6, wherein the first aspect ratio is a first integer multiple of the second aspect ratio, and the second emitter area is a second integer multiple of the first emitter area.

8. The circuit of claim 6, wherein gate terminals of the first and second field effect transistors are coupled to a bias voltage terminal.

9. A master bias current generating circuit, comprising:

a current source;

a first reference leg including a first field effect transistor having a first aspect ratio coupled to the current source and a first diode-connected bipolar transistor having a first emitter area coupled to the first field effect transistor; and a second reference leg including a second field effect transistor having a second aspect ratio less than the first aspect ratio coupled to the current source and a second diode-connected bipolar transistor having a second emitter area greater than the first emitter area coupled to the second field effect transistor; and a first bias leg coupled to the current source and including a third diode-connected field effect transistor coupled to the current source and a third diode-connected bipolar transistor coupled to the third field effect transistor, wherein a gate terminal of the third field effect transistor is coupled to gate terminals of the first and second field effect transistors.

10. The circuit of claim 9, wherein the current source comprises:

a fourth diode-coupled field effect transistor coupled between an input voltage terminal and the first field effect transistor;

a fifth field effect transistor coupled between the input voltage terminal and the second field effect transistor; and a sixth field effect transistor coupled between the input voltage terminal and the third diode-connected field effect transistor, wherein the gate terminals of the fourth diode-connected field effect transistor and the fifth field effect transistor are coupled to one another, and the gate terminal of the sixth field effect transistor is coupled to a drain terminal of the fifth field effect transistor.

11. The circuit of claim 9, wherein the first reference leg includes a fourth field effect transistor coupled between the current source and the first field effect transistor, the second reference leg includes a fifth field effect transistor coupled between the current source and the second field effect transistor, and the circuit further comprises a second bias leg coupled to the current source and including a sixth diode-connected field effect transistor coupled to the current source and a fourth diode-connected bipolar transistor coupled to the sixth field effect transistor, wherein a gate terminal of the sixth diode-coupled field effect transistor is coupled to gate terminals of the fourth and fifth field effect transistors.

12. The circuit of claim 11, wherein the sixth diode-coupled field effect transistor has an aspect ratio less than an aspect ratio of the third diode-coupled field effect transistor.

13. The circuit of claim 11, wherein the current source comprises:

a seventh diode-coupled field effect transistor coupled between an input voltage terminal and the fourth field effect transistor;

an eighth field effect transistor coupled between the input voltage terminal and the fifth field effect transistor;

a ninth field effect transistor coupled between the input voltage terminal and the third diode-connected field effect transistor, wherein the gate terminals of the seventh diode-connected field effect transistor and the eighth field effect transistor are coupled to one another, and a gate terminal of the ninth field effect transistor is coupled to a drain terminal of the eighth field effect transistor; and a tenth field effect transistor coupled between the input voltage terminal and the sixth diode-connected field effect transistor, wherein a gate terminal of the tenth field effect transistor is coupled to a drain terminal of the eighth field effect transistor.

14. A master bias current generating circuit, comprising:

an input voltage terminal;

a ground terminal;

a first reference leg including:

a first transistor coupled to the input voltage terminal, the first transistor being diode-coupled;

a second transistor having a first aspect ratio coupled to the first transistor; and a first diode-connected bipolar transistor having a first emitter area coupled between the second transistor and the ground terminal;

a second reference leg including:

a third transistor coupled to the input voltage terminal and having a gate terminal coupled to a gate terminal of the first transistor;

a fourth transistor having a second aspect less than the first aspect ratio coupled to the third transistor; and a second diode-connected bipolar transistor having a second emitter area greater than the first emitter area coupled between the fourth transistor and the ground terminal; and a first bias leg including:

a fifth transistor coupled to the input voltage terminal and having a gate terminal coupled to a source terminal of the third transistor;

a sixth transistor coupled to the fifth transistor, the sixth transistor being diode-connected and having a gate terminal coupled to gate terminals of the second and fourth transistors; and a third diode-connected bipolar transistor coupled between the sixth transistor and the ground terminal.

15. The circuit of claim 14, further comprising:

a seventh transistor coupled between the first and second transistors;

an eighth transistor coupled between the third and fourth transistors; and a second bias leg including:

a ninth transistor coupled to the input voltage terminal and having a gate terminal coupled to a source terminal of the third transistor;

a tenth transistor coupled to the ninth transistor, the tenth transistor being diode-connected and having a gate terminal coupled to gate terminals of the seventh and eighth transistors; and a fourth diode-connected bipolar transistor coupled between the tenth transistor and the ground terminal.

16. A device, comprising:

an analog block; and a master bias current generating circuit coupled to the analog block, comprising:

a current source;

a first reference leg including a first transistor having a first size parameter coupled to the current source and a first diode having a second size parameter coupled to the first transistor; and a second reference leg including a second transistor having a third size parameter less than the first size parameter and a second diode having a fourth size parameter greater than the second size parameter coupled to the second transistor; and a bias leg coupled to the current source and including a third diode coupled to the current source and a fourth diode coupled to the third diode, wherein the third diode is coupled to bias gate terminals of the first and second transistors.

17. The circuit of claim 16, further comprising at least one digital block formed on a common substrate with the analog block.

18. The circuit of claim 16, wherein the first size parameter includes a first aspect ratio and the third size parameter includes a second aspect ratio, the second size parameter includes a first emitter area and the fourth size parameter includes a second emitter area, and wherein the first aspect ratio is a first integer multiple of the second aspect ratio, and the second emitter area is a second integer multiple of the first emitter area.

* * * * *

UNITED STATES PATENT AND TRADEMARK OFFICE

CERTIFICATE OF CORRECTION

PATENT NO. : 7,449,941 B2
APPLICATION NO. : 11/467314
DATED : November 11, 2008
INVENTOR(S) : Zadeh et al.

It is certified that error appears in the above-identified patent and that said Letters Patent is hereby corrected as shown below:

In column 9, line 43, in Claim 14, after “aspect” insert -- ratio --.

Signed and Sealed this

Twenty-fourth Day of February, 2009

JOHN DOLL
*Acting Director of the United States Patent and Trademark Office*